US005433682A

United States Patent [19]

Fermaglich et al.

[11] Patent Number: 5,433,682

[45] Date of Patent: Jul. 18, 1995

[54] INFANT EXERCISER AND ACTIVITY CENTER

[75] Inventors: Daniel R. Fermaglich; Lois F. Fermaglich, both of Mountain Lakes, N.J.

[73] Assignee: Pediasafe Products, Inc., West Greenwich, R.I.

[21] Appl. No.: 284,256

[22] Filed: Aug. 2, 1994

Related U.S. Application Data

[63] Continuation-in-part of Ser. No. 23,801, Jun. 1, 1994.

[51] Int. Cl.[6] ..... A63B 22/00

[52] U.S. Cl. ..... 482/66; 482/68; 297/344.26; 297/344.21; 135/67

[58] Field of Search ..... D21/192, 193; D6/333, D6/334, 339; D23/278, 296; 297/344.26, 344.21; 482/66, 68; 135/65, 67, 74

[56] References Cited

U.S. PATENT DOCUMENTS

| | | | |
|---|---|---|---|
| 71,220 | 11/1867 | Rohr | 482/66 |
| 82,304 | 9/1868 | Greisler | 482/66 |
| D. 320,528 | 10/1991 | Bernstein et al. | D6/333 |
| 451,128 | 4/1891 | Lawson . | |
| 839,681 | 12/1906 | Voight, Sr. . | |
| 875,377 | 12/1907 | Pilia et al. . | |
| 1,437,179 | 11/1922 | Herson . | |
| 1,469,436 | 10/1923 | Fornia . | |
| 3,049,350 | 8/1962 | Walker . | |
| 3,127,170 | 3/1964 | Caster . | |
| 4,743,008 | 5/1988 | Fermaglich et al. . | |
| 5,085,428 | 2/1992 | Fermaglich et al. . | |
| 5,211,607 | 5/1993 | Fermaglich et al. . | |
| 5,302,163 | 4/1994 | Fermaglich et al. . | |

*Primary Examiner*—Jerome W. Donnelly
*Attorney, Agent, or Firm*—Ralph W. Selitto, Jr.

[57] ABSTRACT

An infant exerciser adapted for use in a substantially stationary location has a combined tray and infant seat which are attached to a base such that the tray and seat can be revolved conjointly in an orbital manner. The seat can also rotate about its own axis of rotation, whereby an infant who is positioned in the seat can walk along a circular path and/or turn in place.

15 Claims, 3 Drawing Sheets

INFANT EXERCISER AND ACTIVITY CENTER

CROSS REFERENCE TO RELATED APPLICATION

This is a continuation-in-part of U.S. Design Application Ser. No. 29/023,801 filed Jun. 1, 1994.

FIELD OF THE INVENTION

The present invention relates, in general, to an infant exerciser, and, more particularly, to an improved infant exerciser which permits an infant to walk in a predetermined path while the exerciser remains stationary, and which also functions as a feeder and/or activity center.

BACKGROUND OF THE INVENTION

Devices which allow an infant to exercise its legs and practice walking have been proposed in the past. For instance, U.S. Pat. Nos. 451,128; 1,437,179; 1,469,436; and 3,049,350 disclose devices which permit a baby to walk in a circular path on or about a substantially stationary base. However, none of these devices is adapted to permit the baby to turn around or change its field of view while seated, thereby inhibiting the ability of the baby to interact with its surrounding environment while simultaneously walking or otherwise exercising its legs.

U.S. Pat. No. 839,681 discloses a baby walker in which a seat is slidably mounted on guide rails supported on a stationary frame. A baby seated in the seat can walk from one end of the guide rails to an opposite end on a fastboard or treadway. Such a device, however, is adapted for unidirectional travel only. That is, once the baby reaches the end of the treadway, the seat must be returned to the other end, thereby requiring assistance from older children or adults. Also, the baby cannot turn around or change its field of view while seated.

U.S. Pat. No. 875,377 discloses a baby walker in which a seat is rotatably mounted on a carriage adapted to move back and forth along a pair of support rods. A baby seated in the seat can walk from one of the support rods to the other end on a platform. Once the baby reaches the opposite end of the platform, he or she can turn the seat around and then walk back to the other end. Because the baby actually walks in a rectilinear fashion along the platform, the baby walker is, out of necessity, comparatively large and cumbersome. Although the mobility of the baby walker is enhanced by trucks (i.e., roller assemblies) provided at the bottom of the walker, such mobility poses a potential hazard in that the walker can be accidentally or unintentionally moved close to stairs or dangerous appliances, such as stoves and heaters.

U.S. Pat. No. 3,127,170 discloses a children's play table with a chair attached to a base. The chair can rotate about the central vertical axis of the table. However, because the chair is secured to a horizontal support rod by screws, the chair is prevented from rotating or spiraling about an axis of rotation passing through the center of the chair. Also, while an infant seated in the chair is able to pull and push the chair around the table, the infant can not actually walk while seated in the chair.

To overcome the disadvantages and shortcomings of the devices described above, the inventors herein have, in the past, obtained a number of patents on inventions having the common objective of providing an infant with the ability to practice walking in or along a predefined and controlled location or path, while simultaneously changing its field of view to orient itself to and interact with the surrounding environment. For instance, U.S. Pat. No. 4,743,008 discloses an infant exerciser having a seat which is rotatably supported in a central opening of an annular tray and a treadmill assembly which is suspended below the seat. An infant placed in the seat is thus able to move its legs in a walking motion on the treadmill and is able to change its field of view by rotating the seat relative to the tray. U.S. Pat. Nos. 5,085,428; 5,211,607; and 5,302,163 all relate to infant exercisers having a stationary frame in the form of a circular tray and an infant seat attached to the frame such that it can be revolved around the tray in an orbital manner. The seat can also rotate about its own axis of rotation, whereby an infant who is in the seat can walk along a circular path and/or turn in place.

SUMMARY OF THE INVENTION

In accordance with the present invention, the inventors have developed a new and improved infant exerciser adapted for use in a substantially stationary location on a support surface, such as a floor. More particularly, the new and improved infant exerciser includes a base, which is immovably positioned relative to the support surface, and a tray, which has a determinate circumferential length measured between opposed ends thereof. A supporting mechanism, including an infant seat, is positioned in the tray between the ends thereof. The supporting mechanism is adapted for rotation about a first axis of rotation passing through the supporting mechanism, whereby an infant in the seat can spin about such axis while positioned in the seat. A first mounting assembly extends between the base and an inner peripheral portion of the tray so as to rotatably mount the tray on the base such that the inner peripheral portion of the tray is maintained at a predetermined height above the base and such that the tray is revolvable about a second axis of rotation in a circular path along which an infant in the seat may walk. A second mounting assembly extends between an outer peripheral portion of the tray and the base so as to mount the outer peripheral portion of the tray at the same height as the inner peripheral portion thereof. The mounting assemblies cooperate to maintain the tray in a substantially horizontal orientation over an underlying portion of the base as an infant in the seat walks in a circle and/or spins in place.

BRIEF DESCRIPTION OF THE DRAWINGS

For a more complete understanding of the present invention, reference may be had to the following detailed description of an exemplary embodiment considered in conjunction with the accompanying drawings, in which.

DETAILED DESCRIPTION OF THE EXEMPLARY EMBODIMENT

Figure 1:
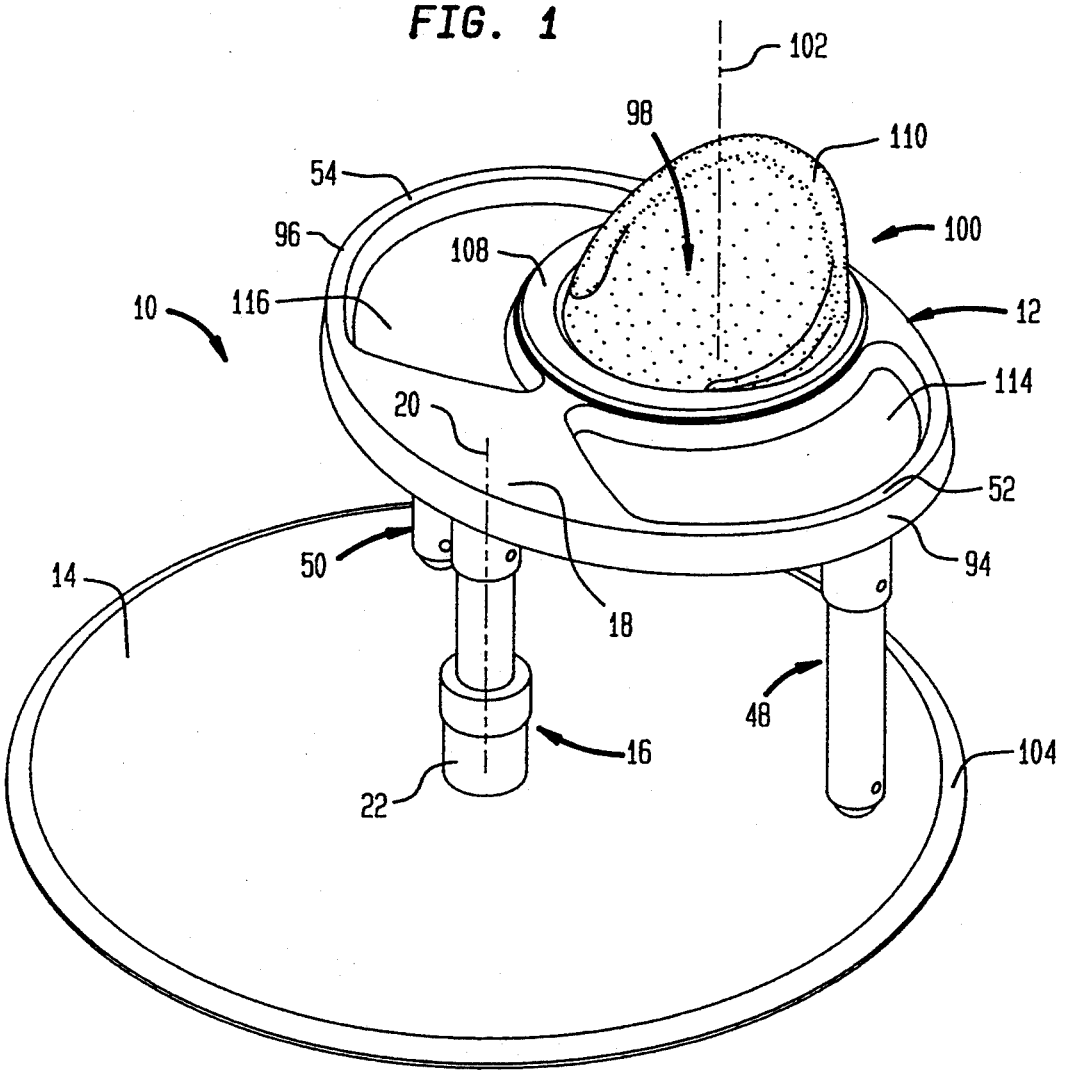
FIG. 1 is a perspective view of an improved infant exerciser and activity center constructed in accordance with one exemplary embodiment of the present invention.
Figure 2:
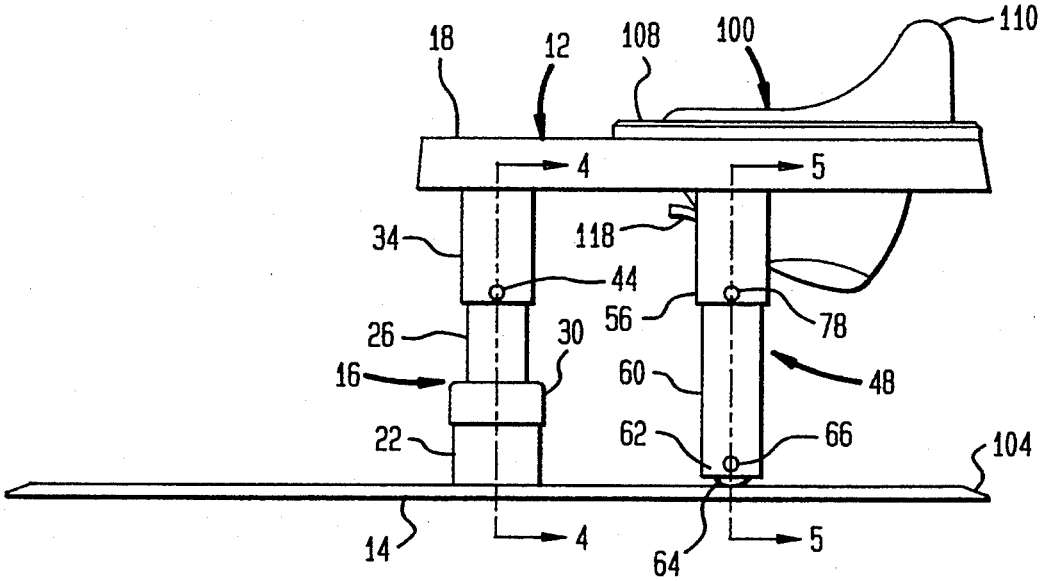
FIG. 2 is a side elevational view of the infant exerciser and activity center illustrated in FIG. 1.
Figure 3:
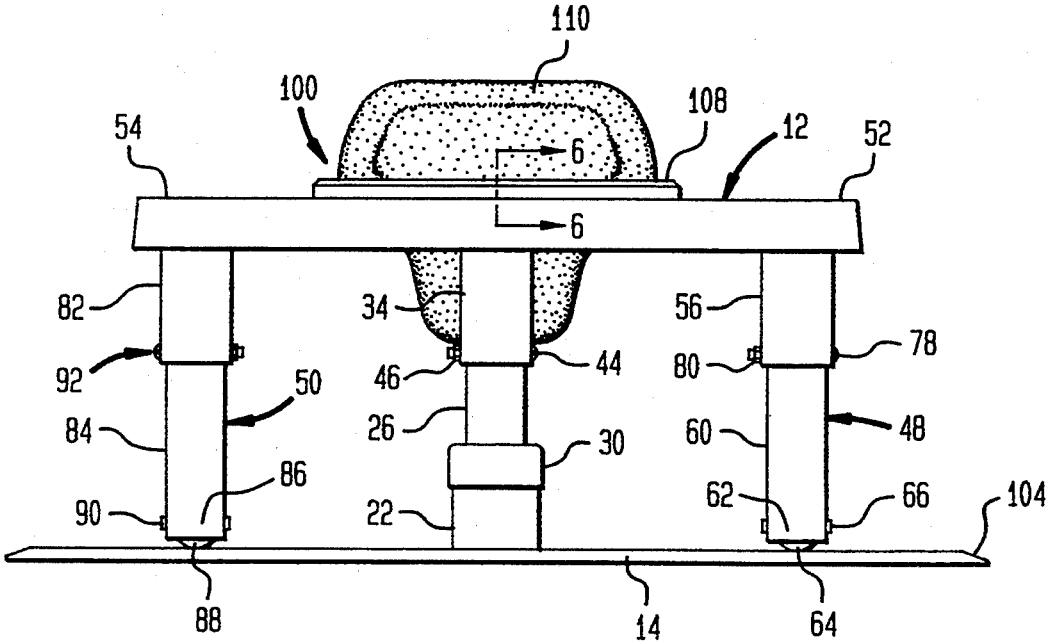
FIG. 3 is a front elevational view of the infant exerciser and activity center illustrated in FIGS. 1 and 2.

Referring to FIGS. 1–6, an infant exerciser and activity center 10 has an oval tray 12, which is arranged in a substantially horizontal orientation relative to a stationary base 14 having a circular shape. The tray 12 is supported by a mounting post assembly 16, which extends from the center of the base 14 to an inner peripheral portion 18 of the tray 12. The mounting post assembly 16 supports the tray 12 such that its inner peripheral portion 18 is maintained at a predetermined, but adjustable, height above the base 14 and such that the tray 12 is revolvable in a circular path about a substantially vertical axis 20, which is substantially coincident with a central axis of the base 14.

Figure 4:
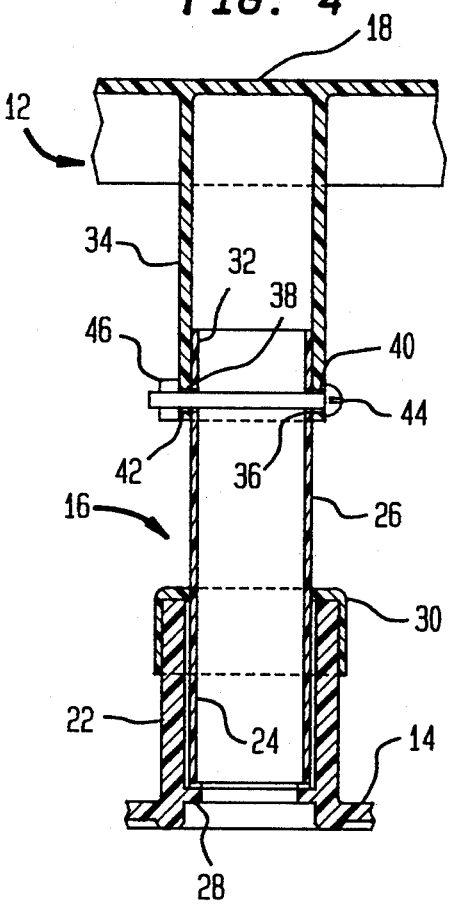
FIG. 4 is a cross-sectional view taken along section line 4—4 of FIG. 2 and looking in the direction of the arrows.

With particular reference to FIG. 4, the mounting post assembly 16 includes a tubular socket 22, which extends upwardly from the base 14 so as to rotatably receive a lower end 24 of a tubular post 26. The socket 22 includes an inner flange 28, which supports the lower end 24 of the post 26 within the socket 22. An annular cap 30 rests atop the socket 22 and circumscribes the post 26. An upper end 32 of the post 26 extends into a sleeve 34, which depends from the inner peripheral portion 18 of the tray 12 and which receives the upper end 32 of the post 26. The upper end 32 of the post 26 is provided with aligned holes 36, 38; while the sleeve 34 is provided with aligned holes 40, 42 adapted for alignment with the holes 36, 38. A threaded bolt 44 extends through the aligned holes 36, 38, 40, 42 and cooperates with a nut 46 to releasably attach the post 26 to the sleeve 34 and to prevent the post 26 from rotating relative to the sleeve 34.

Referring again to FIGS. 1–3, the tray 12 is also provided with mounting legs 48, 50, which depend from outer peripheral portions 52, 54, respectively, of the tray 12 and which extend downwardly to the base 14. The mounting legs 48, 50 support the outer peripheral portions 52, 54, respectively, of the tray 12 such that they are maintained at the same height as the inner peripheral portion 18 of the tray 12, whereby the tray 12 is maintained in a substantially horizontal orientation over an underlying portion of the base 14.

Figure 5:
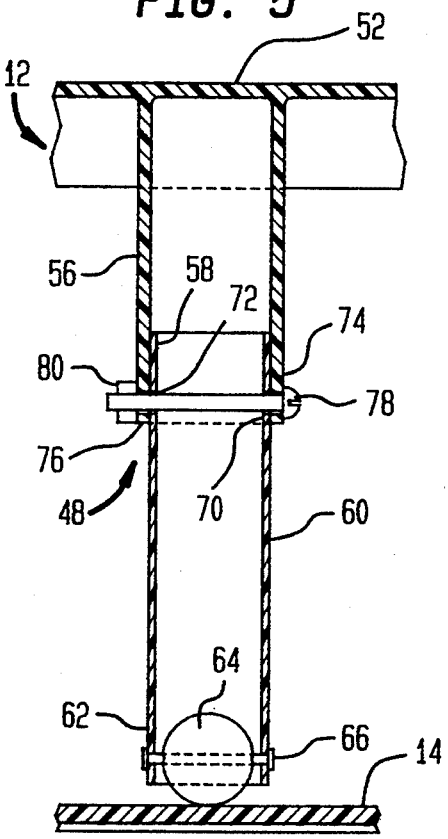
FIG. 5 is a cross-sectional view taken along section line 5—5 of FIG. 2 and looking in the direction of the arrows.

With particular reference to FIG. 5, the mounting leg 48 includes a sleeve 56, which depends from the outer peripheral portion 52 of the tray 12 and which receives an upper end 58 of a post 60. A lower end 62 of the post 60 is provided with a roller ball 64, which is rotatably mounted in the lower end 62 of the post 60 by a pin 66 and which is in rolling engagement with the base 14. The upper end 58 of the post 60 is provided with aligned holes 70, 72; while the sleeve 56 is provided with aligned holes 74, 76 adapted for alignment with the holes 70, 72. A threaded bolt 78 extends through the aligned holes 70, 72, 74, 76 and cooperates with a nut 80 to releasably attach the post 60 to the sleeve 56 and to prevent the post 60 from rotating relative to the sleeve 56.

Referring again to FIGS. 2 and 3, the mounting leg 50 includes a sleeve 82, which depends from the outer peripheral portion 54 of the tray 12 and which receives an upper end (not visible) of a post 84. A lower end 86 of the post 84 is provided with a roller ball 88, which is rotatably mounted in the lower end 86 of the post 84 by a pin 90 and which is in rolling engagement with the base 14. Because the mounting leg 50 is essentially identical to the mounting leg 48, a bolt and nut combination 92 (see FIG. 3) functions to releasably attach the post 84 to the sleeve 82 and to prevent the post 84 from rotating relative to the sleeve 82.

Figure 6:
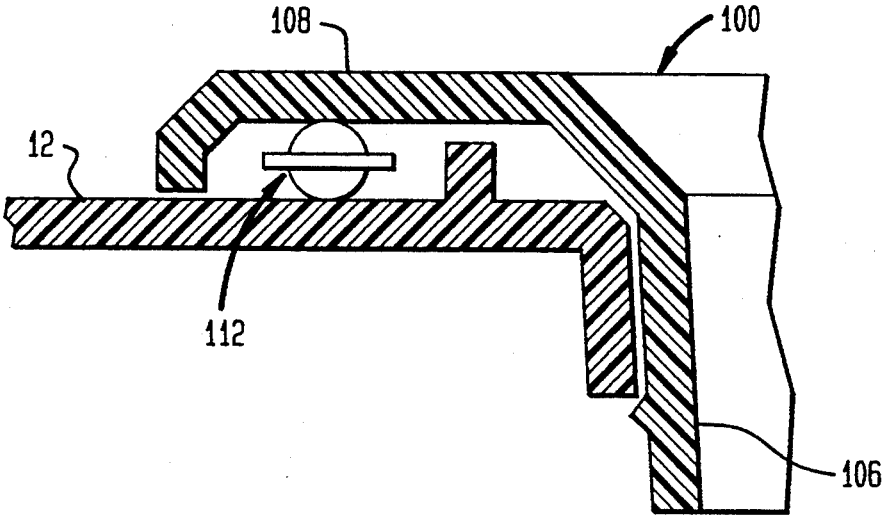
FIG. 6 is a cross-sectional view taken along section line 6—6 of FIG. 3 and looking in the direction of the arrows.

With particular reference to FIGS. 1 and 6, the tray 12, which has a determinate circumferential length measured between ends 94, 96 thereof, is also provided with an opening 98 intermediate the ends 94, 96. The opening 98 has a size and shape selected so as to accommodate a seat assembly 100, which is adapted to support an infant (not shown) for rotation about a substantially vertical axis 102 passing through the center of the opening 98 and positioned between the vertical axis 20 and an outer edge 104 of the base 14.

The seat assembly 100 includes a frame 106 (see FIG. 6) having an annular skirt 108, which extends above the tray 12 and which circumscribes the opening 98. The seat assembly 100 also includes a fabric seat 110 mounted on the frame 106 and adapted to permit an infant to sit thereon. An annular roller bearing race 112 (see FIG. 6) is positioned between the tray 12 and the skirt 108 of the frame 106 so as to support the seat assembly 100 such that the seat assembly 100 can freely rotate about the axis 102, whereby an infant in the seat 110 can spin about the axis 102. Depressions 114, 116 in the tray 12 can be used to hold objects, such as toys, bottles, plates and the like. The seat 110 includes a belt or strap 118 (see FIG. 2) adapted to permit the height of the seat 110 to be adjusted to accommodate different size infants. It should be understood that the height of the seat 110 above the base 14 can be adjusted by any other conventional means, such as by varying the length of the mounting post assembly 16 and the mounting legs 48, 50.

In use, an infant is placed in the seat 110 of the seat assembly 100, either before or after the height of the seat 1 10 has been adjusted to permit the infant's feet to contact the base 14. The infant is then free to exercise or walk in an arcuate path along the base 14, which remains stationary because it is immovably positioned on a floor or some other suitable support surface. As the infant walks or otherwise exercises, he or she can also rotate (i.e., spin) the seat assembly 100 in a complete a circle (i.e., a full 360 degrees) or a partial circle, thereby permitting the infant to better interact with its surrounding environment and to associate the walking movements with changing its location. It should be understood that the infant exerciser and activity center 10 provides the infant with the option of walking and/or spinning in either a clockwise direction of a counterclockwise direction, as well as with the option of changing such direction at will.

The infant exerciser and activity center 10 can also be used as a feeder by, for instance, actuating suitable locking mechanisms (not shown) to immobilize both the tray 12 and the seat assembly 100, whereby the infant's position relative to the tray 12 and to the base 14 is substantially fixed. Due to the compact size of the tray 12 (i.e., it overlies only about one-third of the base 14) and its oval shape, accessibility to an infant positioned in the seat assembly 100 is improved to an extent which permits feeding or other interaction from virtually all directions and/or angles. The compact size of the tray 12 also facilitates assembly, handling, and storage of the infant exerciser and activity center 10.

It will be understood that the embodiment described herein is merely exemplary and that a person skilled in the art may make many variations and modifications without departing from the spirit and scope of the invention. For example, the sizes and shapes of the various elements which form the infant exerciser and activity center 10 can be varied. Thus, the tray 12 and the base 14 need not be oval and circular, respectively. Also, the circular cross-sectional shape of the mounting post assembly 16 and the mounting legs 48, 50 could be changed to any other suitable shape, such as rectangular, square, etc. All such variations and modifications are intended to be included within the scope of the invention as defined in the appended claims.

We claim:

1. An infant exerciser adapted for use in a substantially stationary location on a support surface comprising a planar base, said base being flat for substantially immovable positioning on the support surface; a tray having a determinate circumferential length measured between a first end of said tray and a second end of said tray; supporting means, positioned in said tray between said first and second ends thereof, for supporting an infant for rotation about a first axis of rotation passing through said supporting means, said supporting means including an infant seat and rotating means for enabling said seat to freely rotate, about said first axis of rotation whereby an infant in said seat can spin about said first axis of rotation; first mounting means, extending between said base and an inner peripheral portion of said tray, for rotatably mounting said tray relative to said base, said first mounting means including a post positioned below said tray and defining a second axis of rotation about which said tray is freely orbital in clockwise and counter clockwise directions and about which said seat is revolvable in a circular path having a predetermined and fixed radius relative to said second axis of rotation, said post extending between said base and said inner peripherial portion of said tray colinearly with said second axis of rotation, and said first mounting means maintaining said inner peripheral portion of said tray at a predetermined height above said base, whereby an infant in said seat can walk along said circular path as said seat revolves about said second axis of rotation; and second mounting means, extending between an outer peripheral portion of said tray and said base, for mounting said outer peripheral portion of said tray at said predetermined height, said second mounting means including at least one leg having a free end in rolling engagement with said base, whereby said tray is maintained in a substantially horizontal orientation over an underlying portion of said base as an infant in said seat walks along said circular path and/or spins about said first axis of rotation.

2. An infant exerciser according to claim 1, wherein said second axis of rotation is substantially coincident with a central axis of said base.

3. An infant exerciser according to claim 2, wherein said first axis of rotation is positioned between said second axis of rotation and an outer peripheral edge of said base, whereby an infant in said seat is constrained to walk on said base.

4. An infant exerciser according to claim 3, wherein said first mounting means further includes a socket extending upwardly from said base along said central axis thereof, and a sleeve extending downwardly from said inner peripheral portion of said tray, said sleeve being positioned above said socket and non-rotatably receiving an upper end of said post, and said socket rotatably receiving a lower end of said post.

5. An infant exerciser according to claim 3, wherein said second mounting means includes a plurality of legs, each leg including a free end housing rolling means for rolling along said base.

6. An infant exerciser according to claim 5, wherein said rolling means includes a roller ball rotatably mounted in said free end of each of said legs.

7. An infant exerciser according to claim 5, wherein said plurality of legs includes a first leg positioned adjacent to said first end of said tray and a second leg positioned adjacent to said second end of said tray.

8. An infant exerciser according to claim 1, wherein said supporting means includes a frame positioned in an opening extending through said tray, said frame including an annular skirt extending above said tray and circumscribing said opening therein.

9. An infant exerciser according to claim 8, wherein said rotating means includes an annular roller bearing race positioned between said tray and said skin of said frame.

10. An infant exerciser according to claim 1, wherein said seat is positioned intermediate said first and second ends of said tray.

11. An infant exerciser according to claim 10, wherein said tray includes storing means for storing toys, bottles and other articles.

12. An infant exerciser according to claim 11, wherein said storing means includes a first depression positioned between said seat and said first end of said tray and a second depression positioned between said seat and said second end of said tray.

13. An infant exerciser according to claim 1, wherein said tray overlies about one-third of said base, whereby an infant in said seat may be attended by an individual approaching said tray from virtually all directions and angles.

14. An infant exerciser according to claim 1, wherein said seat includes adjusting means for adjusting the height of said seat above said base.

15. An infant exerciser according to claim 14, wherein said adjusting means includes a belt provided on said seat.

* * * * *